US008085219B2

(12) United States Patent
Song et al.

(10) Patent No.: US 8,085,219 B2
(45) Date of Patent: Dec. 27, 2011

(54) PLASMA DISPLAY DEVICE AND DRIVING METHOD THEREOF

(75) Inventors: Keunyoung Song, Yongin-si (KR); Chanyoung Han, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 940 days.

(21) Appl. No.: 11/944,779

(22) Filed: Nov. 26, 2007

(65) Prior Publication Data

US 2008/0122751 A1 May 29, 2008

(30) Foreign Application Priority Data

Nov. 27, 2006 (KR) ..... 10-2006-0117887

(51) Int. Cl.
*G09G 3/28* (2006.01)

(52) U.S. Cl. ..... 345/60

(58) Field of Classification Search ..... 345/60, 345/67

See application file for complete search history.

(56) References Cited

U.S. PATENT DOCUMENTS

| | | | | |
|---|---|---|---|---|
| 5,854,540 | A | 12/1998 | Matsumoto et al. | |
| 5,963,184 | A * | 10/1999 | Tokunaga et al. | 345/60 |
| 6,414,653 | B1 * | 7/2002 | Kobayashi | 345/60 |
| 6,597,334 | B1 * | 7/2003 | Nakamura | 345/68 |
| 7,408,531 | B2 * | 8/2008 | Tsuchida et al. | 345/63 |
| 2003/0137471 | A1 * | 7/2003 | Iwami | 345/60 |
| 2007/0109226 | A1 * | 5/2007 | Lee | 345/67 |

FOREIGN PATENT DOCUMENTS

| | | |
|---|---|---|
| JP | 10-288973 | 10/1998 |
| JP | 11-065522 | 3/1999 |
| JP | 11-265163 | 9/1999 |
| KR | 2001-73683 | 8/2001 |
| KR | 10-573163 | 4/2006 |
| KR | 10-592320 | 6/2006 |
| KR | 10-2006-0086056 | 7/2006 |

OTHER PUBLICATIONS

Patent Abstracts of Japan and English machine translation of Japanese Publication 11-065522, 1999.
Patent Abstracts of Japan and English machine translation of Japanese Publication 11-265163, 1999.

* cited by examiner

*Primary Examiner* — Richard Hjerpe
*Assistant Examiner* — Jeffrey A Parker
(74) *Attorney, Agent, or Firm* — Christie, Parker & Hale, LLP

(57) ABSTRACT

A plasma display device and a driving method thereof which can prevent address discharging from low discharging. The driving method of the plasma display device includes a plasma display panel having first to third electrodes divided into a plurality of groups including a first group and a second group, and a frame divided into a plurality of sub-fields, each sub-field divided into a reset period, an address period, and a sustain period, the method includes during an address period: sequentially supplying the first group with a scan pulse, supplying a sub scan pulse to the second group, and sequentially supplying the second group with the scan pulse.

20 Claims, 4 Drawing Sheets

PLASMA DISPLAY DEVICE AND DRIVING METHOD THEREOF

CROSS-REFERENCE TO RELATED APPLICATION

This application claims the benefit of Korean Application No. 2006-117887, filed Nov. 27, 2006, in the Korean Intellectual Property Office, the disclosure of which is incorporated herein by reference.

BACKGROUND OF THE INVENTION

1. Field of the Invention

An aspect of the present invention relates to a plasma display device and a driving method thereof, and more particularly, to a plasma display device and a driving method thereof which can prevent address discharging from low discharging. The driving method of the plasma display device includes a plasma display panel having first to third electrodes, a frame divided into a plurality of sub-fields, and each sub-field divided into a reset period, an address period, and a sustain period, the method comprising: among the first electrodes classified in a plurality of groups including a first group and a second group for the address period, sequentially supplying the first group with a scan pulse, supplying a sub scan pulse to the second group, and sequentially supplying the second group with the scan pulse.

2. Description of the Related Art

The plasma display panel forms an image by using a visible ray that is emitted from a phosphorous material, which is excited by ultraviolet rays generated by plasma obtained by a gaseous discharge. The plasma display panel is sealed and a gas is injected into a space formed between an upper substrate and a lower substrate opposite to each other. A plurality of first and second electrodes alternatively arranged are formed on one side of the display panel between the upper substrate and the lower substrate. A third electrode arranged along a direction that crosses the first and second electrodes is formed on the other side. A discharging cell is formed on the area where the plurality of electrodes intersect, in order to form a unit pixel of the plasma display panel.

The driving method of the plasma display device including the plasma display panel includes an Address and Display period Separated (ADS) driving method. The ADS driving method is a method where a frame is divided into a plurality of subfields, each subfield having a weight value, and each subfield is time-divided to represent gray scale for image display. Each subfield is formed with a reset period, an address period, and a sustain period.

The reset period is a period for rearranging wall charges which are formed in a previous period. The address period is a period for generating a wall discharge needed to sustain discharging in an on-discharging cell. The sustain period is a period for displaying an image on the plasma display panel by using wall charges generated for the address period.

Generally, in the address period, a scan pulse is sequentially supplied to the first electrodes while a bias pulse is supplied to the second electrode. As a result, the on-discharging cell performs the address discharging and thus a wall charge needed for a sustain period is generated. However, this driving method has a disadvantage in that as the number of the first electrodes needed to form a high resolution plasma display panel increases, the closer the electrodes are to each other and the longer the latency time before supplying the scan pulse. Therefore, this can result in scatter and loss of a wall charge rearranged by reset discharging. By losing this wall charge, low discharging occurs in address discharging.

SUMMARY OF THE INVENTION

Accordingly, an aspect of the present invention provides a plasma display device and a driving method thereof which can prevent address discharging from occurring in low discharging.

According to an aspect of the present invention, there is provided a driving method of the plasma display device including a plasma display panel having first to third electrodes, a frame divided into a plurality of sub-fields, each sub-field being divided into a reset period, an address period, and a sustain period, the driving method includes: among the first electrodes classified by a plurality of groups including a first group and a second group for the address period, sequentially supplying the first group with a scan pulse, supplying a sub scan pulse to the second group, and sequentially supplying the second group with the scan pulse.

According to another aspect of the present invention, the first group may include the first electrodes arranged on the upper part of the plasma display panel, and the second group may include the first electrodes arranged on the lower part of the plasma display panel.

According to another aspect of the present invention, the first group may include the odd numbered first electrodes, and the second group may include the even numbered second electrodes.

According to another aspect of the present invention, the operation of supplying the sub-pulse to the second group may include simultaneously or sequentially supplying a scan sub-pulse to the second group, and further include sequentially increasing a voltage level of the scan sub-pulse.

According to another aspect of the present invention, a sustain pulse may be applied to the plurality of first and second electrodes for the sustain period. The scan sub-pulse may be formed to have the same voltage level as the sustain pulse.

According to another aspect of the present invention, there in provided a plasma display device, which includes, a plasma display panel including a plurality of first and second electrodes divided into a plurality of groups having a first group and a second group and a plurality of third electrodes formed in a direction that intersects the plurality of first and second electrodes, a controller configured to divide one frame into a plurality of sub-fields including a reset period, an address period, and a sustain period, and a driver configured to sequentially supply a scan pulse to the first group, supply a sub scan pulse to the second group, and sequentially supply a scan pulse to the second group.

According to another aspect of the present invention, the sub scan pulse is supplied simultaneously or sequentially to the second group.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
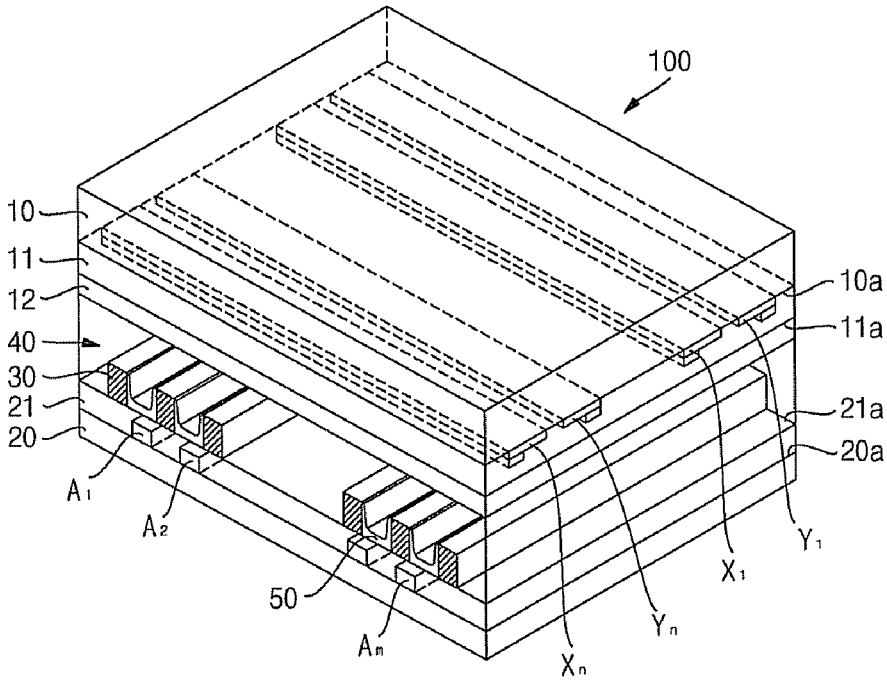
FIG. 1 is a diagram illustrating a structure of a plasma display panel according to one exemplary embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Hereinafter, preferred embodiments of the present invention will be described in more detail with reference to FIGS. 1 to 5. Herein, the term "wall charge" refers to a charge that is formed on a wall of a cell (e.g., dielectric layer) near each electrode. This wall charge does not contact the electrode, but is explained as being formed, accumulated or piled up on the electrode. A wall voltage refers to a potential difference that is formed on the wall of the discharge cell by the wall voltage.

First, a structure of the plasma display panel and an electrode arrangement structure formed in the plasma display panel, according to one embodiment of the present invention, will be explained.

FIG. 1 is a block diagram illustrating a rough structure of the plasma display panel according to one embodiment of the present invention.

Referring FIG. 1, the plasma display panel (100) includes a plurality of first electrodes ($Y_1$ or Yn) and a plurality of second electrodes ($X_1$ or Xn) alternatively arranged between a first substrate (10) and a second substrate (20), and a plurality of third electrodes ($A_1$ or Am, hereafter, referred to as "A electrode") formed in a direction that intersects the first electrodes ($Y_1$ or Yn, hereafter, referred to as "Y electrode") and the second electrodes ($X_1$ or Xn, hereafter, referred to as "X electrode").

The first substrate (10) is formed of a glass-like material having a fixed thickness and forms the plasma display panel (100) with the second substrate (20). A first dielectric layer 11, which covers the Y electrodes ($Y_1$ or Yn) and the X electrodes ($X_1$ or Xn), is formed on a lower surface (10*a*) of the first substrate (10), and a wall charge is formed near the first dielectric layer (11). An MgO protective layer (12) is formed on a lower surface (11*a*) of the first dielectric layer (11). The MgO protective layer (12) increases the discharging efficiency of the secondary electron emission and plays a role in protecting the first induced electricity layer (11) against damage by sputtering of charged particles in discharging.

The second substrate (20) is formed of the same material as the first substrate (10). The second dielectric layer (21), which covers the A electrodes ($A_1$ or Am), is formed at an upper side (20*a*) of a second substrate (20). A barrier rib (30) is formed in a parallel direction to the A electrodes ($A_1$ or Am) at an upper surface (21*a*) of the second dielectric layer (21). The barrier rib (30) divides a discharging cell (40) that is a unit space for discharging to occur. Discharging gas is charged inside the discharging cell (40). A space confined by the second dielectric layer (21) and the barrier rib (30) is coated with a phosphor (50).

When a driving pulse is supplied to the Y electrodes ($Y_1$ or Yn), the X electrodes ($X_1$ or Xn), and the A electrodes ($A_1$ or Am), ultraviolet rays are generated from the discharging cell (40) and the phosphor (50) excited by the ultraviolet rays generates a visible ray. As a result, the screen in the plasma display panel (100) is lit.

Figure 2:
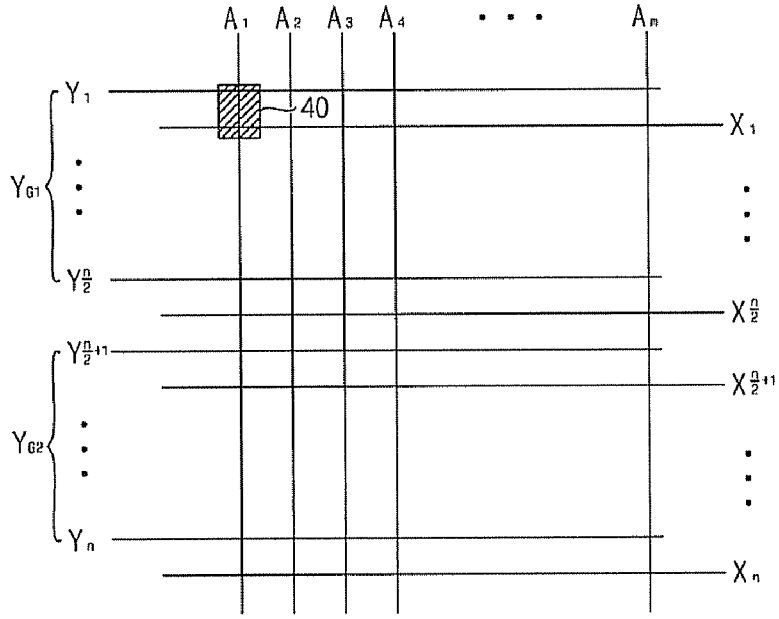
FIG. 2 is a diagram illustrating an arrangement structure of a plurality of electrodes for the plasma display panel of FIG. 1.

FIG. 2 is a block diagram briefly illustrating a structure of the electrode arrangement on the plasma display panel (100) of FIG. 1.

Referring FIG. 2, in the plasma display panel (100), the Y electrodes ($Y_1$ or Yn) and the X electrodes ($X_1$ or Xn) are sequentially arranged and the A electrodes ($A_1$ or Am) are arranged so as to intersect the Y electrodes ($Y_1$ or Yn) and the X electrodes ($X_1$ or Xn). A large number of discharging cells (40) are formed in an area where the Y electrodes ($Y_1$ or Yn), the X electrodes ($X_1$ or Xn), and the A electrodes ($A_1$ or Am) intersect.

The Y electrodes ($Y_1$ or Yn) are divided into a plurality of groups including the first group ($Y_{G1}$) and the second group ($Y_{G2}$) and a driving method having different driving waveforms for each group are supplied. The electrodes can be additionally divided such that the first group ($Y_{G1}$) includes the Y electrodes ($Y_1$ or Yn/2) arranged at the upper side of the plasma display panel (100) and the second group ($Y_{G2}$) includes Y electrodes (Yn/2+1 or Yn) arranged at the lower side of the plasma display panel (100). However, the electrodes can be divided such that the first group ($Y_{G1}$) includes Y electrodes arranged at odd positions among the Y electrodes ($Y_1$ or Yn) and the second group ($Y_{G2}$) includes Y electrodes arranged at even positions among the Y electrodes ($Y_1$ or Yn). Furthermore, the electrodes can be arranged in any other form and thus are not limited to the arrangements disclosed above.

Next, the plasma display device according to one embodiment of the present invention is explained.

Figure 3:
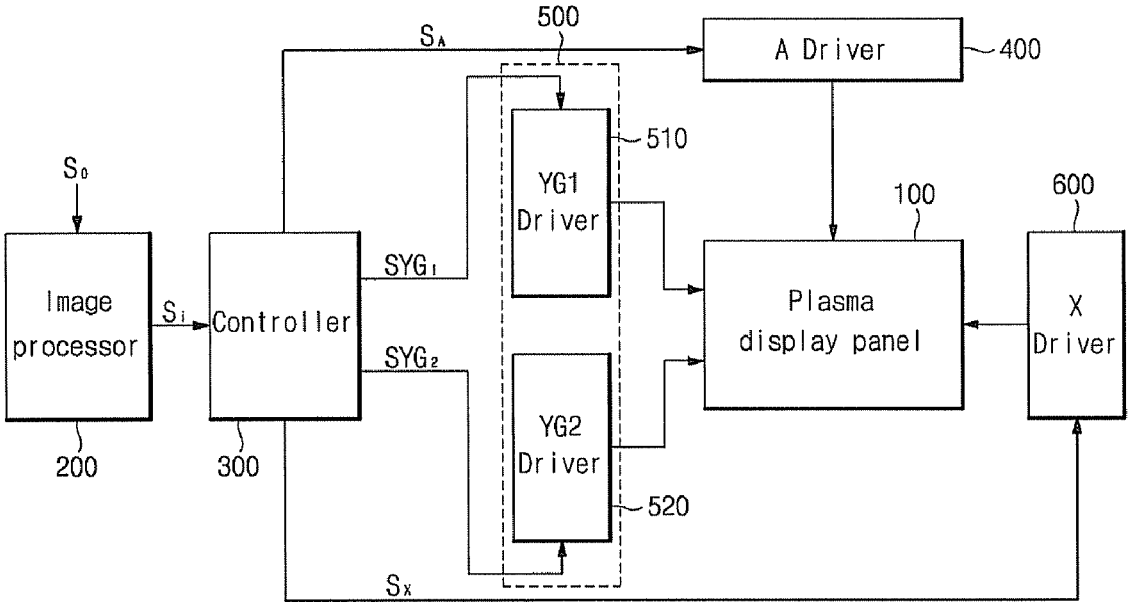
FIG. 3 is a diagram illustrating the plasma display device according to one exemplary embodiment of the present invention.

FIG. 3 is a schematic block diagram illustrating a driving device of the plasma display panel according to an embodiment of the present invention.

Referring to FIG. 3, the plasma display device includes the plasma display panel (100), an image processor (200), a controller (300), and a driver (400, 500, and 600).

The image processor (200) converts an external analog image signal (So) such as PC, DVD, Video, and TV into a digital signal and outputs an internal image signal (Si) through a video-processing of the digital signal. The internal image signal (Si) includes each image data of red, green, and blue, a clock signal, a vertical horizontal sync signal, and so on.

The controller (300) receives the internal image signal (Si) from the image controller (200) and then generates a control signal (SA, $SY_{G1}$, $SY_{G2}$, SX) to control the driver (400, 500, 600) through a gamma correction, an error diffusion, and an Automatic Power Control (APC). The controller (300) divides a frame into a plurality of sub-fields which have different gray level weight values between each other, where each sub-field is divided into a reset period, an address period, and a sustain period, and then driven by a time division technique.

An A driver (400) receives a control signal (SA) from the controller (300) and supplies a driving pulse to the A electrodes ($A_1$ or Am) of the plasma display panel (100).

A Y driver (500) includes a first group driver (510) for supplying a driving pulse to the first group ($Y_{G1}$) and the second group driver (520) for supplying a driving pulse to the second group ($Y_{G2}$). The first group driver (510) and the second group driver (520) receive a control signal ($SYG_1$, $SYG_2$) from each controller (300) and then supply a driving pulse to the first group ($Y_{G1}$) and the second group ($Y_{G2}$). A driving pulse, which is supplied to the Y electrodes ($Y_1$ or Yn) including the first group ($Y_{G1}$) and the second group ($Y_{G2}$), includes a reset pulse, a sub scan pulse, a scan pulse, and a sustain pulse. The scan pulse is sequentially supplied to the first group ($Y_{G1}$) and the second group ($Y_{G2}$).

An X driver (600) receives a control signal (SX) and then supplies X electrodes of plasma display panel (100) with a driving pulse.

Next, the driving method of the plasma display device according to an embodiment of the present invention is described in more detail.

Figure 4:
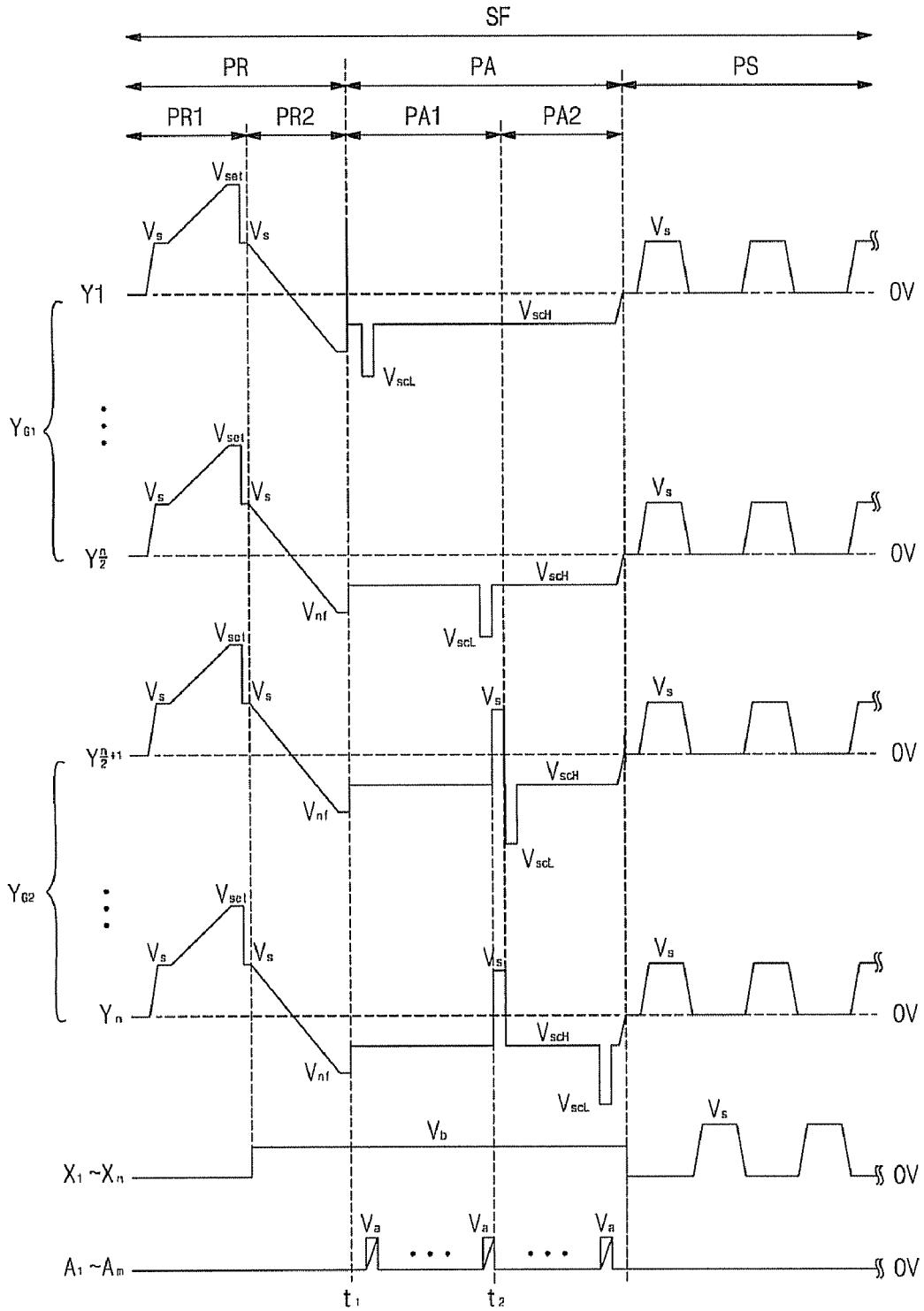
FIG. 4 is a diagram illustrating a driving pulse supplied to the plasma display device according to one exemplary embodiment of the present invention.

Referring to FIG. 4, a driving method of the plasma display device, having a frame is divided into a plurality of sub-fields including a reset period (PR), an address period (PA), and a sustain period (PS), includes sequentially supplying a scan pulse having a voltage of $V_{scL}$ to a first group ($Y_{G1}$) during an address period (PA), supplying a sub scan pulse having a voltage of $V_s$ to a second group ($Y_{G2}$) at a specified time during a portion of the address period while concurrently supplying a voltage $V_{scH}$ that is lower than that of the sub scan pulse to the first group ($Y_{G1}$), and thereafter sequentially supplying the scan pulse $V_{scL}$ to the second group ($Y_{G2}$) during the remainder of the address period.

A reset period (PR), an address period (PA), and a sustain period (PS) for a subfield (SF) will be explained. The driving method of the plasma display device can be applied to other sub-fields, and is therefore not limited to a specific sub field application.

The reset period (PR) is a period for rearranging a wall charge of a discharging cell and includes a reset rising period (PR1) and a reset falling period (PR2). In the reset rising period (PR1), the X electrodes ($X_1$ or Xn) and the A electrodes ($A_1$ or Am) are maintained at 0V (or Ground) and then, an increasing reset rising pulse as high as Vs voltage corresponding to Vset is supplied to the Y electrodes ($Y_1$ or Yn). Accordingly, a weak reset discharging is performed in a discharging cell, a wall charge of negative polarity is accumulated in the Y electrodes ($Y_1$ or Yn), and a wall charge of positive polarity is accumulated in the X electrodes ($X_1$ or Xn) and the A electrodes ($A_1$ or Am). In the reset failing period (PR2), the X electrodes ($X_1$ or Xn) and the A electrodes ($A_1$ or Am) are maintained at Vb voltage and 0V (or Ground), respectively and a reset falling pulse Vs voltage is supplied to the Y electrodes ($Y_1$ or Yn) and decreased to a Vnf voltage. Accordingly, a weak reset discharging is performed in a discharging cell, the wall charge of negative polarity accumulated in the Y electrodes ($Y_1$ or Yn) is removed, and the wall charge of positive polarity accumulated in the X electrodes ($X_1$ or Xn) and the A electrodes (A1 or Am) is removed. At the end of time (t1) of the reset period (PR), the wall charge is properly formed and thus able to perform smooth address discharging.

Next, the address period (PA) is a period for selecting an on-cell among discharging cells, and includes the first address period (PA1) for address discharging in a discharging cell where the first group ($Y_{G1}$) is included and the second address period (PA2) for an address discharging in a discharging cell where the second group ($Y_{G2}$) is included. Firstly, in the first address period (PA1), X electrodes ($X_1$ or Xn) are maintained at the Vb voltage, and a scan pulse is sequentially supplied to the first group ($Y_{G1}$) and an address pulse corresponding to the scan pulse is supplied to the A electrodes ($A_1$ or Am). The scan pulse is a square wave pulse having a voltage of VscL level of negative polarity and the address pulse is a square wave pulse having Va voltage of positive polarity. Accordingly, in a discharging cell where the first group ($Y_{G1}$) is included, a wall voltage, which is formed by a wall charge in the reset period (PR), is added to a potential difference (Va-VscL) between the first group ($Y_{G1}$) and the A electrodes ($A_1$ or Am) and then, address discharging is performed. Through the address discharging, a wall charge needed for a sustain discharging is generated in a discharging cell where the first group ($Y_{G1}$) is included.

In the second address period (PA2), X electrodes ($X_1$ or Xn) are maintained at the Vb voltage, and the scan pulse is sequentially supplied to the second group ($Y_{G2}$) and an address pulse corresponding to the scan pulse is supplied to the A electrodes ($A_1$ or Am). The scan pulse and the address pulse are pulses with the same voltage level as a pulse supplied in the first address period (PA). Accordingly, in a discharging cell where the second group ($Y_{G2}$) is included, a wall voltage, which is formed by a wall charge in the reset period (PR), is added to a voltage formed by the second group ($Y_{G2}$) and the A electrodes ($A_1$ or Am) and then, address discharging is performed. Through the address discharging, a wall charge needed for a sustain discharging is generated in a discharging cell where the second group ($Y_{G2}$) is included.

On the other hand, a driving method of the plasma display panel according to an embodiment of the present invention includes: address discharging in a discharging cell where the first group ($Y_{G1}$) is included, and then, address discharging in a discharging cell where the second group ($Y_{G2}$) is included. Therefore, to perform address discharging in a discharging cell where the second group ($Y_{G2}$) is included, because it takes time for address discharging in the first group ($Y_{G1}$) in the first address period (PA1), there is the possibility that a condition of wall charge is scattered and lost after an end time (t1) of a reset period (PR).

To prevent such a problem, a sub scan pulse is supplied to the second group ($Y_{G2}$) in the first address period (PA1). Accordingly, an embodiment of the present invention has a wall charge at the same condition as the ending time (t1) of the reset period (PR) before starting the second address period (PA2).

For the first address period (PA1), the sub scan pulse is formed to have a proper voltage level and pulse width as a wall charge lost at a discharging cell where the second group ($Y_{G2}$) is included. In the case where a voltage level of the sub scan pulse is too high or a width of the pulse is too wide, a mal-discharging can occur in a discharging cell where the second group ($Y_{G2}$) is included before the address discharging. Therefore, the sub-scan pulse should be formed to have a proper width. It is desirable to first input the sub-scan pulse at time (t2) right before starting the second address period (PA2). Therefore address discharging occurring as low discharging can be prevented right before an address discharging in a discharging cell where the second group ($Y_{G2}$) is included, by rearranging a condition of a wall charge of the discharging cell where the second group ($Y_{G2}$) is included.

A sub scan pulse used in an embodiment of the present invention is formed to have the same voltage level as the sustain pulse Vs voltage. Although the sub scan pulse is formed at the same level as the sustain pulse, because there is no address discharging in the second group ($Y_{G2}$) during the first address period (PA1), a wall charge needed for the sustain discharging is insufficient. Therefore, discharging does not occur. But in this case, if the width of the sub scan pulse is too wide, a surplus wall charge is generated and there might be mal-discharging in the second address period (PA2). Therefore, the width of the sub scan pulse should be selected within a range that mal-discharging does not occur and loss of a wall charge is prevented. Also, according to an embodiment of the present invention, the higher the voltage level of the scan pulse, the more a wall charge. Therefore, as the sub scan pulse approaches the Y electrode arranged at the lower part of the plasma display panel, an embodiment of the present invention makes the sub scan pulse supplied to the second group ($Y_{G2}$) to sequentially have a higher voltage level. Accordingly, the conditions of a wall charge of Y electrodes included to the second group ($Y_{G2}$) can be more evenly rearranged.

According to an embodiment of the present invention, the sub scan pulse is set to have the same voltage level as the sustain pulse. Therefore, problems associated with having another voltage source added to the Y driver (500) can be solved as well as loss of a wall charge from occurring during the address period (PA).

Finally, under a condition that the A electrodes ($A_1$ or Am) are maintained at 0V (or Ground), the sustain pulse with the Vs voltage is supplied to the Y electrodes ($Y_1$ or Yn) and the X electrodes ($X_1$ or Xn), in an amount corresponding to weight value of gray level of a corresponding sub-field (SF) for the sustain period (PS). Because of the wall voltage generated due to a voltage difference (Vs) between the Y electrodes ($Y_1$ or Yn) and the X electrodes ($X_1$ or Xn) and the wall charge generated for the address period (PA), the sustain discharging is performed and a image can be displayed on the plasma display panel.

Next, the driving method of the plasma display device according to an embodiment of the present invention will be explained.

Figure 5:
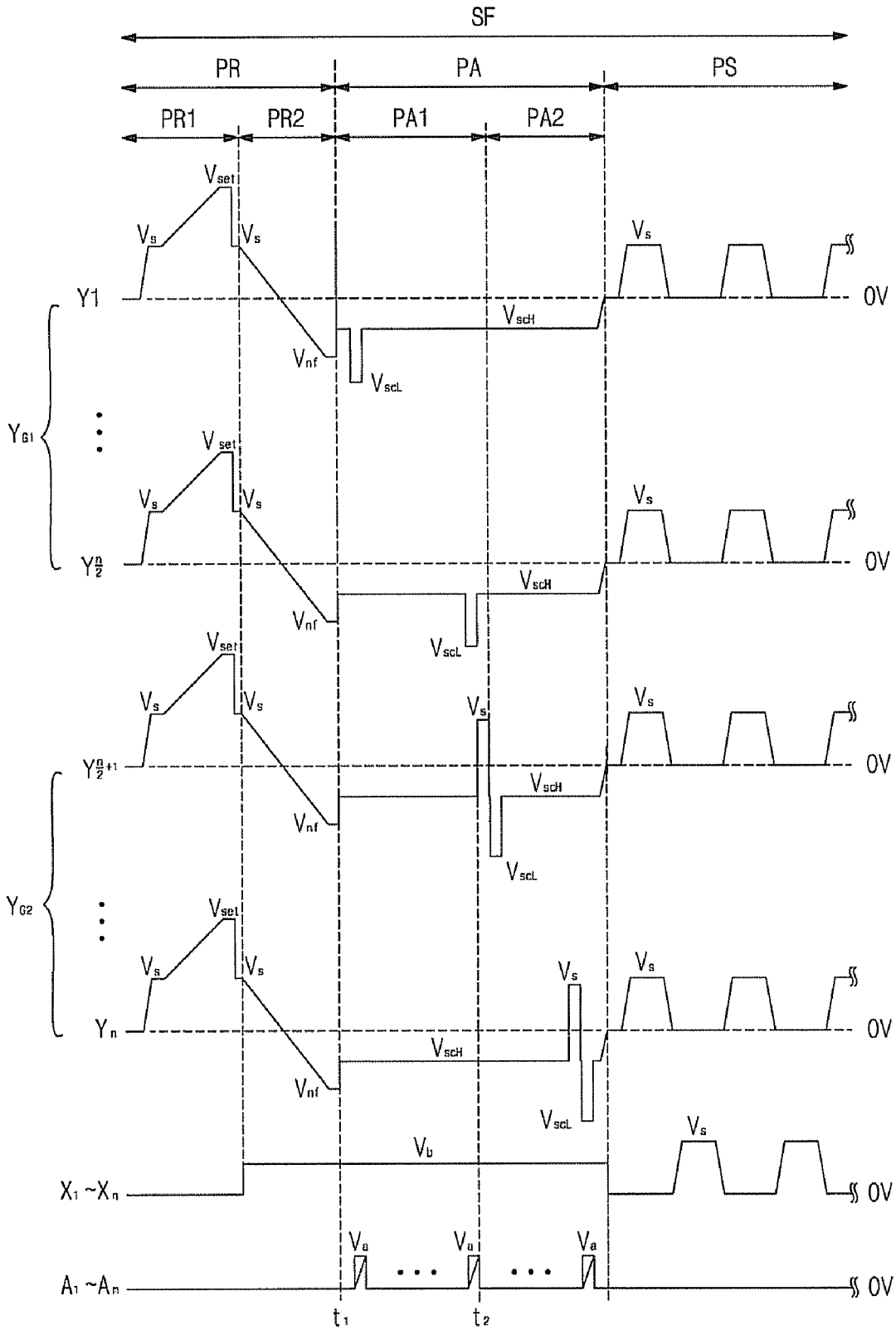
FIG. 5 is a diagram illustrating the driving pulse supplied to the plasma display device according to another exemplary embodiment of the present invention.

FIG. 5 is a block diagram illustrating a driving pulse supplied to the plasma display device according to a driving method of the present embodiment.

Referring to FIG. 5, the driving method of the plasma display device having a frame divided into a plurality of sub-fields including a reset period (PR), an address period (PA), and a sustain period (PS) includes sequentially supplying a scan pulse to the first group ($Y_{G1}$) for the address period (PA), supplying a sub scan pulse to the second group ($Y_{G2}$), and sequentially supplying a scan pulse to the second group ($Y_{G2}$).

The driving pulse supplied to the plasma display device of FIG. 5 is the same or similar to that of FIG. 4. Therefore, the explanation for the same or similar constituent of the driving pulse will be omitted.

According to another embodiment of the present invention, a sub scan pulse, which rearranges a wall charge for an address period (PR), is sequentially supplied to the second group ($Y_{G2}$). Time (t2) corresponds to a time when the sub scan pulse is first supplied to the second group ($Y_{G2}$) right before a scan pulse is first supplied to the second group ($Y_{G2}$). Thereafter, the sub scan pulse is supplied to each Y electrode right before the scan pulse is supplied to the second group ($Y_{G2}$). Such a sub scan pulse is formed to have a proper voltage level and pulse width as a wall charge lost at a discharging cell included in the second group ($Y_{G2}$) for the first address period (PA1) and the second address period (PA2) can be restored. At this time, where voltage level of the sub scan pulse is too high or the pulse width is too wide, there can be mal-discharging before an address discharging occurs in the discharging cell where the second group ($Y_{G2}$) is included. Therefore, the sub scan pulse should be formed to have a proper width. The sub scan pulse is sequentially supplied to Y electrodes arranged at a lower part of the plasma display panel and a condition of the wall charge of Y electrodes included in the second group ($Y_{G2}$) can be evenly rearranged.

On the other hand, according to an embodiment of the present invention, Y electrodes are described as being divided into two groups, but the Y electrodes can be divided into more than two groups according to an embodiment of the present invention. The sub scan pulse can be supplied d between each group. In this time, the sub scan pulse can be simultaneously or sequentially supplied. Also, the nearer the sub scan pulse to the last group, the higher the voltage level can be. The sub scan pulses may be the same voltage level.

As described above, the plasma display device and its driving method according to an embodiment of the present invention produce the following effects.

First, in the address period the Y electrodes are divided into a plurality of groups including the first group and the second group and a scan pulse is sequentially supplied to the electrodes. Accordingly, by dividing the electrodes into groups and sequentially supplying the groups with a sub scan pulse right before supplying the scan pulse to the last group in the address period in which the scan pulse is sequentially supplied, low address discharging can be prevented as well as loss of the wall charge.

Second, the sub scan pulse is formed to have the same level as the sustain pulse, thereby eliminating the need of an additional power source for the Y driver.

It should be understood by those of ordinary skill in the art that various replacements, modifications and changes in the form and details may be made therein without departing from the spirit and scope of the present invention as defined by the following claims. Therefore, it is to be appreciated that the above described embodiments are for purposes of illustration only and are not to be construed as limitations of the invention.

What is claimed is:

1. A driving method of a plasma display device having a plasma display panel including a plurality of first to third electrodes, the first electrodes being divided into a plurality of groups including a first group and a second group and where one frame is divided into a plurality of sub-fields, each sub-field being divided into a reset period, an address period, and a sustain period, the method comprising during the address period:

sequentially supplying a scan pulse to the first group;

supplying a sub scan pulse to the second group while concurrently supplying a voltage lower than that of the sub scan pulse to the first group during a second ; and sequentially supplying the scan pulse to the second group.

2. The driving method of claim 1, wherein the first group comprises the first electrodes arranged at an upper side of the plasma display panel and the second group comprises the first electrodes arranged at a lower side of the plasma display panel.

3. The driving method of claim 1, wherein the first group comprises odd-numbered first electrodes from among the first electrodes and the second group comprises even-numbered first electrodes from among the first electrodes.

4. The driving method of claim 1, wherein the sub scan pulse is simultaneously applied to the second group.

5. The driving method of claim 1, wherein the sub scan pulse is sequentially supplied to the second group.

6. The driving method of claim 5, wherein a voltage level of the sub scan pulse is sequentially increased.

7. The driving method of claim 1, further comprising alternatively supplying a sustain pulse to the plurality of the first and second electrodes during the sustain period.

8. The driving method of claim 7, wherein the sub scan pulse has a same voltage level as the sustain pulse.

9. A plasma display device, comprising:

a plasma display panel including a plurality of first and second electrodes divided into a plurality of groups including a first group and a second group and a plurality of third electrodes formed in a direction so as to intersect the first and second electrodes;

a controller to divide a frame into a plurality of sub-fields that includes a reset period, an address period, and a sustain period; and a driver to sequentially supply a scan pulse to the second group during a second address period of the address period after sequentially supplying a scan pulse to the first group and supplying a sub scan pulse to the second group during a first address period of the address period while concurrently supplying a voltage lower than that of the sub scan pulse to the first group.

10. The plasma display device of claim 9, wherein the first group comprises the first electrodes arranged at an upper side of the plasma display panel and the second group comprises the first electrodes arranged at a lower side of the plasma display panel.

11. The plasma display device of claim 9, wherein the first group comprises odd-numbered first electrodes from among the first electrodes and the second group comprises even-numbered first electrodes from among the first electrodes.

12. The plasma display device of claim 9, wherein the sub scan pulse is simultaneously supplied to the second group.

13. The plasma display device of claim 9, wherein the sub scan pulse is sequentially supplied to the second group.

14. The plasma display device of claim 13, wherein a voltage level of the sub scan pulse is sequentially increased.

15. The plasma display device of claim 9, wherein a sustain pulse is alternatively supplied to the plurality of the first and second electrodes during the sustain period.

16. The plasma display device of claim 15, wherein the sub scan pulse has a same voltage level as the sustain pulse.

17. A method of driving a plasma display device having a plasma display panel including a plurality of first to third electrodes, the first electrodes being divided into a plurality of groups including a first group and a second group and a frame divided into a plurality of sub-fields, each subfield divided into a reset period, an address period, and a sustain period, the method comprising:

sequentially supplying a scan pulse to the first group;

supplying a sub scan pulse to the second group while concurrently supplying a voltage lower than that of the sub scan pulse to the first group; and sequentially supplying the scan pulse to the second group, wherein the scan pulse supplied to the first group is supplied during a first address period of the address period, the sub scan pulse supplied to the second group is supplied during the first address period of the address period and the scan pulse supplied to the second group is supplied during a second address period of the address period, preventing address discharging during a low discharge.

18. The method of claim 17, wherein a voltage level of the sub scan pulse is sequentially increased.

19. A method of driving a plasma display device having a plasma display panel including a plurality of first to third electrodes, the first electrodes being divided into a plurality of groups including a first group and a second group and a frame divided into a plurality of sub-fields, each subfield divided into a reset period, an address period, and a sustain period, the method comprising:

sequentially supplying a scan pulse to the first group; and sequentially supplying a sub scan pulse and the scan pulse to the second group, wherein the scan pulse supplied to the first group is supplied during a first address period of the address period, and the sub scan pulse and the scan pulse supplied to the second group is supplied during a portion of the first address period and during a second address period of the address period, preventing address discharging during a low discharge.

20. The method of claim 19, wherein a voltage level of the sub scan pulse is sequentially increased.

* * * * *